US008179213B2

(12) United States Patent
Yanagisawa et al.

(10) Patent No.: US 8,179,213 B2
(45) Date of Patent: May 15, 2012

(54) ELECTROMAGNETIC WAVE TRANSMISSION MEDIUM COMPRISING A FLEXIBLE CIRCULAR TUBE WITH A SOLID CIRCLE SHAPED RIDGE DISPOSED THEREIN

(75) Inventors: Wasuke Yanagisawa, Tokyo (JP); Hiroshi Mizutani, Tokyo (JP); Yasunobu Ishii, Tokyo (JP); Mitsuhiro Suzuki, Tokyo (JP); Ryo Horie, Tokyo (JP)

(73) Assignee: Yokowo Co., Ltd, Tokyo (JP)

( * ) Notice: Subject to any disclaimer, the term of this patent is extended or adjusted under 35 U.S.C. 154(b) by 217 days.

(21) Appl. No.: 12/496,979

(22) Filed: Jul. 2, 2009

(65) Prior Publication Data

US 2010/0001809 A1 Jan. 7, 2010

(30) Foreign Application Priority Data

Jul. 4, 2008 (JP) ..... 2008-176173

(51) Int. Cl.
*H01P 3/12* (2006.01)

(52) U.S. Cl. ..... 333/242; 333/248

(58) Field of Classification Search ..... 333/239, 333/241, 242, 248

See application file for complete search history.

(56) References Cited

U.S. PATENT DOCUMENTS

| | | | | |
|---|---|---|---|---|
| 3,090,020 | A * | 5/1963 | Lunden | 333/239 |
| 3,136,965 | A * | 6/1964 | Lunden | 333/239 |
| 3,224,004 | A * | 12/1965 | Barthez | 343/771 |
| 3,987,454 | A * | 10/1976 | Epis | 343/771 |
| 5,363,464 | A * | 11/1994 | Way et al. | 385/125 |
| 6,172,583 | B1 * | 1/2001 | Niekamp et al. | 333/254 |

FOREIGN PATENT DOCUMENTS

| | | |
|---|---|---|
| JP | 4118451 | 8/1966 |
| JP | 4518273 | 7/1970 |
| JP | 8195605 | 7/1996 |

* cited by examiner

*Primary Examiner* — Benny Lee
(74) *Attorney, Agent, or Firm* — Ingrassia Fisher & Lorenz, P.C.

(57) ABSTRACT

Provided is an electromagnetic wave transmission medium which is suited for mass production and does not affect a transmission mode. The electromagnetic wave transmission medium includes, as a main element, a flexible cylindrical tube (1) molded so that a cross-sectional shape of the cylindrical tube in a direction orthogonal to a tube axis is uniform in a direction of the tube axis. The cylindrical tube (1) includes an inner wall formed of a conductive layer having a thickness equal to or more than a skin depth. The cross-sectional shape is a circular ridge waveguide shape having a ridge (1*b*) which is oriented to a cylindrical axis and is symmetric with respect to a center, and the ridge (1*b*) has a structure to be fed with electricity.

20 Claims, 6 Drawing Sheets

(a)

(b)

ELECTROMAGNETIC WAVE TRANSMISSION MEDIUM COMPRISING A FLEXIBLE CIRCULAR TUBE WITH A SOLID CIRCLE SHAPED RIDGE DISPOSED THEREIN

CROSS REFERENCE TO RELATED APPLICATION

This application claims priority to Japanese Patent Application No. 2008-176173, filed Jul. 4, 2008, which is incorporated herein by reference in its entirety.

FIELD OF THE INVENTION

The present invention relates to an electromagnetic wave transmission medium with a novel structure for transmitting frequencies of a microwave band or higher.

BACKGROUND

Examples of the electromagnetic wave transmission medium for connecting high frequency devices to each other whose relative position cannot be determined with precision or one or both of which are changed in position include a coaxial line and a flexible waveguide. The coaxial line is frequently used for its excellent flexibility and relatively inexpensive price. However, the diameter of the coaxial line needs to be smaller as the frequency increases, and therefore, problems arise such as an increase in transmission loss, an increase in machining accuracy for maintaining a transmission characteristic, deterioration in durability, and so on. For example, when polytetrafloroethylene (i.e., TEFLON®) is used for an insulator, and a cutoff frequency $f_c$ is set to 100 [GHz] in the coaxial line, its inner diameter becomes about 1[mm]. In such a small coaxial line, not only the loss is increased but also a slight mechanical error greatly affects the transmission characteristic.

The flexible waveguide is excellent in terms of the transmission loss prevention. However, because the flexible waveguide has a tube wall part which is required to be formed into a specific shape (for example, a bellows shape, such as in Japanese Utility Model Examined Publication No. Sho 41-018451 and Japanese Utility Model Examined Publication No. Sho 45-018273), the production efficiency is significantly lowered. In addition, for the flexible waveguide to realize a structure in which millimeter waveband exceeding, for example, 30 [GHz] can be used, a complicated and high-level processing technique is required. Also, such a thin flexible waveguide lacks in durability.

In addition to the bellows-shaped metal waveguide, there exists a waveguide having an ellipsoidal cross section, in which thin conductors are tiled on the surface of a dielectric rod (Japanese Patent Application Laid-open No. Hei 08-195605). Such a waveguide is obtained by merely winding a metal tape on the surface of the dielectric rod that has been prepared, or subjecting the dielectric rod to conductive plating. Therefore, there is an advantage in that the waveguide can be manufactured at reduced cost. However, such a waveguide has a large transmission loss and insufficient flexibility. Further, the transmission mode becomes unstable when the waveguide is bent because the cross section is ellipsoidal, resulting in such a problem that the characteristic changes.

SUMMARY OF THE INVENTION

It is an object of the present invention to provide an electromagnetic wave transmission medium with a novel structure which does not increase the manufacturing costs even if a frequency band of an electromagnetic wave to be used is high, and does not adversely affect the transmission mode even if the transmission medium is bent.

The electromagnetic wave transmission medium according to the present invention includes a flexible cylindrical tube molded so that a cross-sectional shape of the flexible cylindrical tube in a direction orthogonal to a tube axis is uniform in a direction of the tube axis. The cylindrical tube includes an inner wall formed of a conductive layer having a thickness equal to or more than a skin depth, the cross-sectional shape is a circular ridge waveguide shape having a ridge which is oriented to a cylindrical axis and is symmetric with respect to a center, and the ridge has a structure to be fed with electricity.

In the present specification, the expression "skin depth" means a distance from the surface at which a high frequency current is 37% of that at the surface due to the skin effect. At that distance, a current is 1/e of that at the surface, where e is the base (about 2.72) of natural logarithm, and 1/e is about 0.37. The loss occurring in a conductor layer is approximately given by an ohm loss when it is assumed that a current flows from the surface to a point of the skin depth in an evenly spread manner.

It is only necessary that the conductor layer is equal to or more than the skin depth, and therefore, for example, a cylindrical tube may be manufactured by forming the conductor layer on a tubular surface made of a resin.

In an aspect of the present invention, the cross-sectional shape is a closed surface shape in which an arc of a first circle and an arc of a second circle having arc angles of 180 degrees or lower at regular intervals from a symmetric axis of the first circle are connected to each other, and the arc of the second circle forms the ridge. In this case, a size of the cross-sectional shape is preferably a size in which an electromagnetic wave introduced into an internal space of the cylindrical tube is cut off by a cutoff frequency fc ($=1.84C/(\Pi\sqrt{\epsilon}(D+d))$), where C is a free space velocity of the electromagnetic wave, D is an inner diameter of the first circle, d is an inner diameter of the second circle, and $\lambda c$ is a cutoff wavelength of the electromagnetic wave propagating through the internal space.

The internal space may be a free space, and the internal space may be filled with a dielectric material. From the viewpoint of enhancing an added value, another transmission medium is arranged in an area surrounded by the arc of the second circle. As a result, two transmission lines can be formed by one transmission line.

In the electromagnetic wave transmission medium according to the present invention, the cylindrical tube is molded so that the cross-sectional shape of the cylindrical tube in a direction orthogonal to the tube axis is uniform in the tube axis, and an impedance range matched by the ridge can be widened. Therefore, even if the frequency is high (for example, even at the millimeter waveband), there are advantages in that machining is easy, and the mass productivity is increased high. The cross-sectional shape is circular in surface, and therefore, the transmission medium is resistant to bending in all directions. Particularly, the ridge acts as a reinforcement member when the tube is bent, and the transmission mode can be stabilized. As a result, it is possible to suppress the deterioration of the characteristic.

BRIEF DESCRIPTION OF THE DRAWINGS

The present invention will hereinafter be described in conjunction with the following drawing figures, wherein like numerals denote like elements which may not be described in detail for all drawings in which they appear, and.

DETAILED DESCRIPTION OF THE PREFERRED EMBODIMENTS

The following detailed description is merely exemplary in nature and is not intended to limit the invention or the application and uses of the invention. Furthermore, there is no intention to be bound by any theory presented in the preceding background of the invention or the following detailed description.

An electromagnetic wave transmission medium according to the present invention is a transmission medium with a novel structure, and in this embodiment, a transmission medium with a structure similar to a circular ridge type waveguide will be exemplified.

Structure

Figure 1:
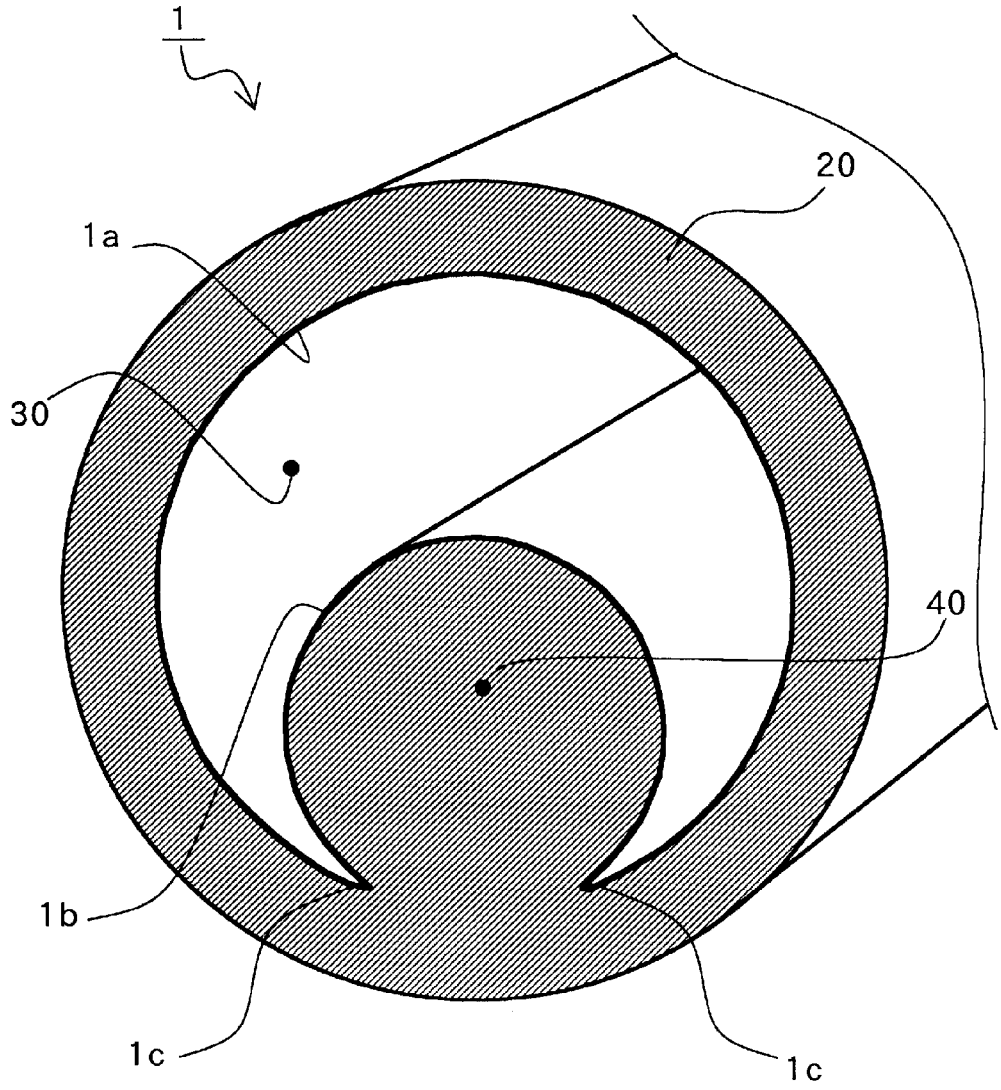
FIG. 1 is a perspective view showing a cross-sectional structural example of an electromagnetic wave transmission medium according to an embodiment of the present invention.

An electromagnetic wave transmission medium described in this embodiment includes a flexible cylindrical tube as a main element. FIG. 1 is a diagram showing a cross-sectional shape of the cylindrical tube in a direction orthogonal to a tube axis. Referring to FIG. 1, a cylindrical tube 1 is of a cross section being a closed surface shape in which an arc of a first circle 1 a and an arc of a second circle lb which is disposed inside of the first circle la and has arc angles at regular intervals from a symmetric axis (a diameter passing through the center) of the first circle are connected to each other by a pair of cusps l*c*of the second circle l*b*. A portion of the closed surface which comes in contact with a transmission space 30 for propagation of an electromagnetic wave is formed with a conductive layer. A thickness of the conductive layer is equal to or more than at least a skin depth. The conductive layer has the thickness of the skin depth or more. As described above, the skin depth is a distance from the surface at which the high frequency wave current is 37% of that at the surface due to the skin effect. The skin depth is about several microns or lower in the millimeter waveband.

The cross-sectional shape corresponds to a circular ridge waveguide shape, and the arc portion of the second circle 1*b* corresponds to a ridge that is symmetrical with respect to the cross-sectional center.

An internal space surrounded by the arc of the second circle 1*b* is called "depression space 40". The arc angles of the second circle 1*b* can take values ranging from 90 degrees (180 degrees in total) to 180 degrees (360 degrees in total) to the right and left from the symmetrical axis according to the frequency to be used, respectively. In the case of 180 degrees (360 degrees in total), the depression space 40 is configured such that the second circle 1*b* is inscribed in an inner wall of the first circle 1*a*.

The cross-sectional shape shown in FIG. 1 is so molded as to be uniform in the tube axial direction of the cylindrical tube 1.

Manufacture Process

The cylindrical tube 1 can be manufactured as follows:

First, a drawing die allowing the transmission space 30 within the above-mentioned closed surface to remain is produced, and a resin base is pultruded by using the drawing die. As a result, an outer sheath 20 and a circular ridge are formed into a circular cross-section as a whole. The pultrusion molding method is a molding method in which the resin base is drawn from a steel die to obtain a cylinder whose cross section is a closed surface shape. The pultrusion molding method can extend the resin base as long as needed toward a direction substantially vertical to a cross section taken along a direction perpendicular to the tube axis of the cylinder tube. As a result, moldings (cylindrical tubes) having the increased strength in one direction while maintaining the same cross-sectional shape can be mass-produced.

The outer sheath 20 is made of glass fiber or other stiffening material for improving the bending strength against bending. For more facilitation of bending, the outer sheath 20 may have a moderate elastomer property.

After the pultrusion molding has been conducted on the resin base by using the drawing die, base plating for increasing a peeling strength and surface plating for reducing a skin resistance are subjected to the transmission space 30. A diffusion prevention layer may be sandwiched between the ground plating and the surface plating. The surface plating is formed with a conductive layer. The conductive layer is preferably selected from any one of silver, copper, and gold which are high in conductivity.

The transmission space 30 is the free space, and therefore, the space 30 can contribute to improvement in the transmission loss. Alternatively, the transmission space 30 may be filled with the dielectric material. In this case, the transmission loss increases more than that of the free space, but improvement in the bending strength against the bending of the transmission line, and an electric reduction of the transmission line diameter can be realized.

Figure 2:
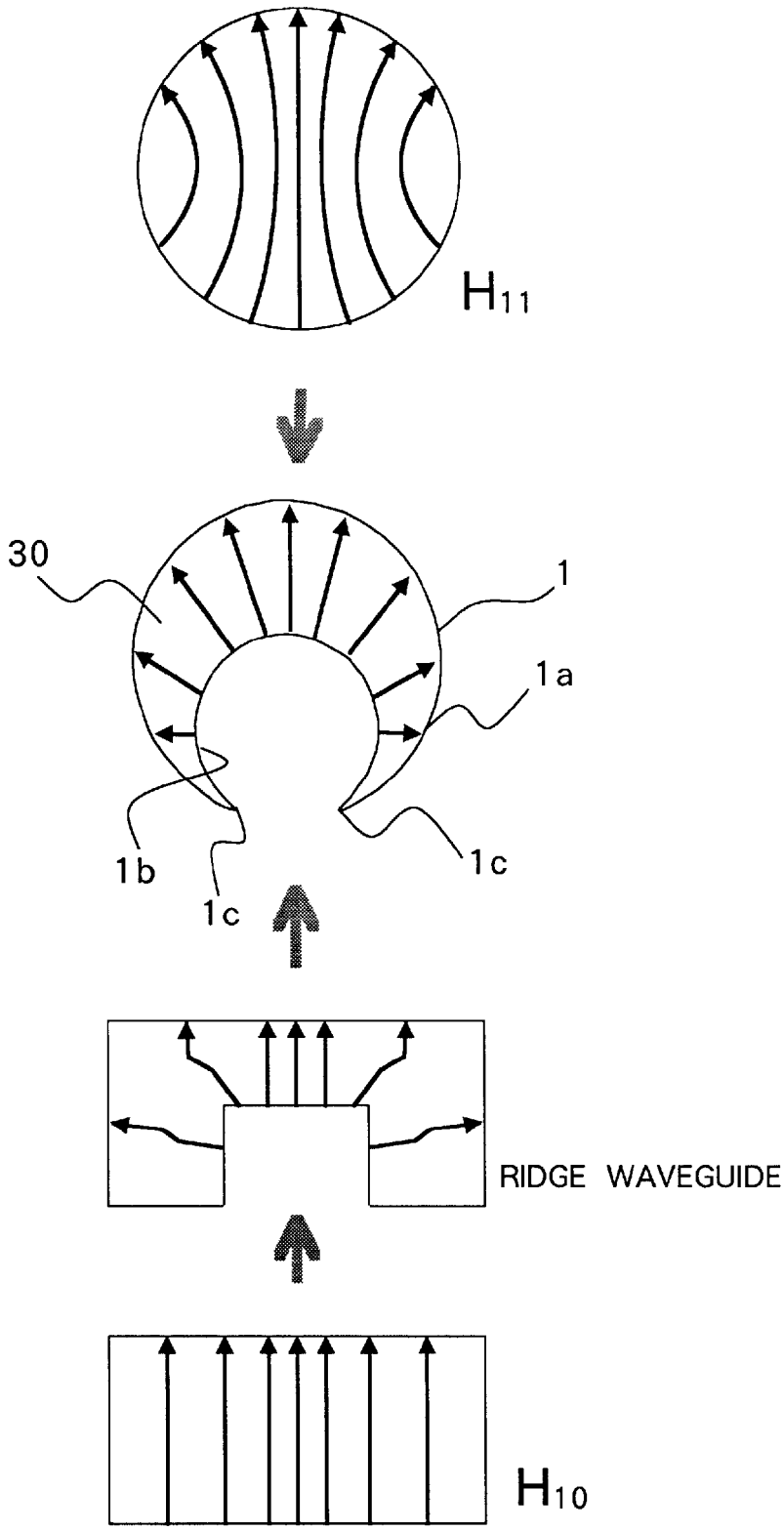
FIG. 2 is an explanatory diagram showing a relationship between an electric field distribution of the electromagnetic wave transmission medium according to this embodiment and an electric field distribution of a transmission line with another cross-sectional structure.

In the electromagnetic wave transmission medium manufactured as described above, the transmission mode of the electromagnetic wave introduced in the transmission space 30 is substantially identical with a rectangular waveguide of H10 mode and a circular waveguide of H11 mode in that a pair of electric field poles are provided within the cross section. That is, the electromagnetic wave transmission medium substantially inherits the electric field distribution characteristic of the ridge waveguide being application of the circular waveguide and the rectangular waveguide as shown in the electric field distribution diagram of FIG. 2.

In particular, in an example according to this embodiment, the arc of the second circle is made to act as the ridge, thereby allowing a range in which the impedance is matched to be enlarged, but also the position of the electric field poles to be fixed. As a result, even if bending occurs, the transmission mode in the transmission space 30 can be stabilized. This is largely different from the circular waveguide and the coaxial line in which the electric field distribution changes due to bending.

In the above description, an example was given in which a drawing die allowing the transmission space 30 within the closed surface to remain is produced, and after the resin base is pultruded by using the drawing die, the conductive layer is formed thereon. Alternatively, it is possible that a base having the cross-sectional shape of the transmission space 30 is produced, and the conductive layer is formed on the surface of the base. Also, after formation of the conductive layer, the resin base may be removed as needed, to form the free space. In this case, the base may be made of a material other than the resin.

Input/Output Connection

Figure 3:
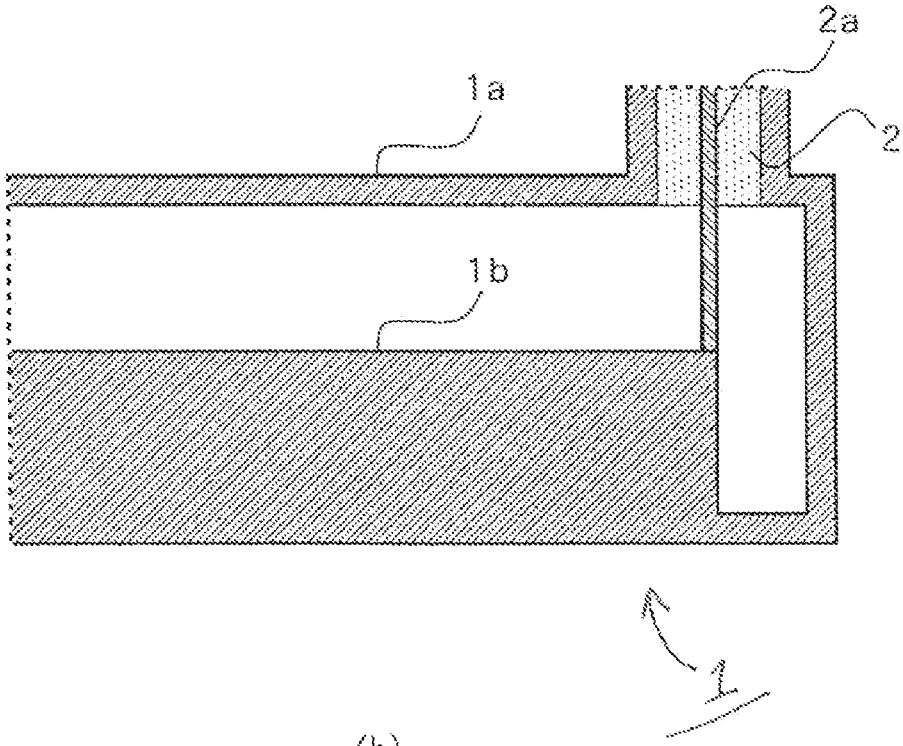
FIGS. 3A and 3B are diagrams showing a state of an input/output connection, FIG 3A showing an example in which a connection is made from an upper surface of an end to a ridge, and FIG. 3B showing an example in which the connection is made from an end surface to the ridge.
Figure 3:
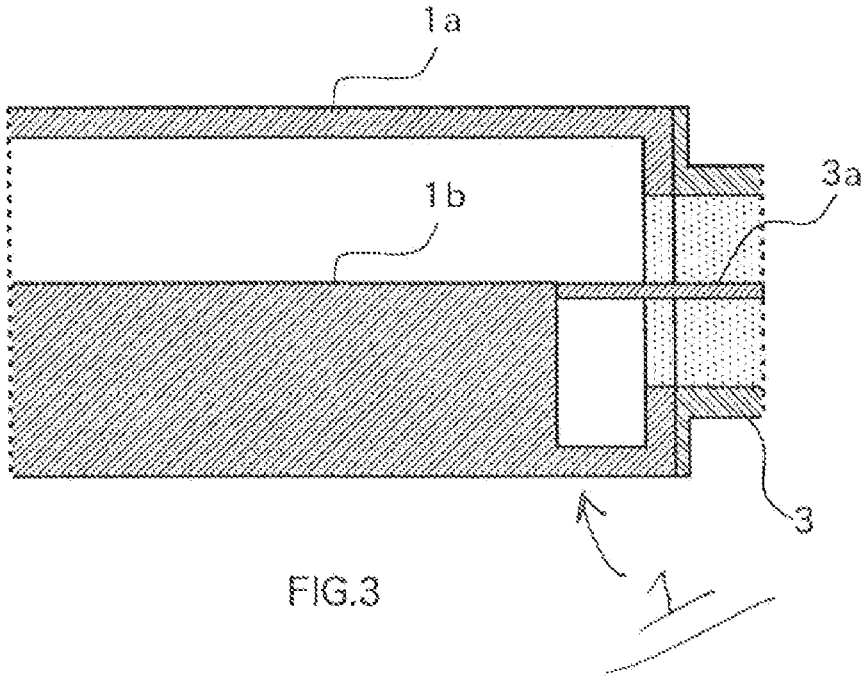

The electromagnetic wave transmission medium according to this embodiment can be connected to a high-frequency electronic device via a connector. FIG. 3A is a side cross-sectional view showing the structure of an end portion of the cylindrical tube 1. In the vicinity of the end of the first circle 1*a* in the cylindrical tube 1 is disposed a connection hole 2 for enabling attachment of another transmission line 2*a* made of conductor. The electric field has the maximum value on the symmetric axis, and hence the transmission line 2*a* is brought in contact with the second cylinder 1*b*, that is, the ridge through the connection hole 2 on the symmetric axis. FIG. 3B shows a state in which the connector 3 is disposed at an end of the cylindrical tube 1. The center portion of the connector 3 is a transmission line 3*a* made of conductor. The transmission line 3*a* is also positioned on the symmetric axis. During the connection, the transmission line 3*a* is brought in contact with the second circle 1*b,* that is, the ridge.

Characteristics

Subsequently, the characteristics of the electromagnetic wave transmission medium according to this embodiment will be described.

When an inner diameter of the first circle 1*a* is D, an outer diameter of the second circle 1*b* is d, the cutoff frequency is fc, and the cutoff wavelength is λc, the cutoff frequency fc can be approximately determined by the following expression, in which C is a free space velocity of the electromagnetic wave:

$$fc = C/\lambda c$$
$$= 1.84C/(\Pi\sqrt{\varepsilon}(D+d))$$

The cutoff frequency $f_c$ of the coaxial line must be a frequency lower than the highest usable frequency of the coaxial line, and therefore, the coaxial line has a maximum size limitation whereas the electromagnetic wave transmission medium according to this embodiment has a minimum size limitation. For that reason, the electromagnetic wave transmission medium is remarkably advantageous in an extremely high frequency application.

The transmission characteristic impedance is determined by d/D. The transmission characteristic impedance can be selected to be about 0.5 to 0.75 in the electromagnetic wave waveguide. The ratio is comprehensively determined according to a relationship of the contour size, the cutoff frequency, the transmission loss, and the flexibility.

For use in the transmission line of a millimeter waveband, for example, about 66 [GHz], an outer diameter of the outer sheath 20 is about 4 to 4.5 [mm], an inner diameter of the first circle is about 2 to 2.5 [mm], and an outer diameter of the second circle is about 1 to 1.8 [mm]. An inner diameter of the coaxial line having the same pass band is 1 [mm], which is twice the inner diameter of the first circle. Therefore, the conductor loss due to a current density is remarkably reduced, and the pass loss can be reduced to the half or lower. Also, the thickness of the conductive layer is about 1 micron that is three times as large as the skin depth for the purpose of reducing the skin resistance. Further, appropriate selection of the material and outer diameter of the outer sheath 20 enables the bending deformation of the transmission space accompanied with bending to be avoided. The arc angles of the second circle 1*b* are selected to be about 160 degrees (about 320 degrees in total) to the right and left from the center axis, respectively.

Figure 4:
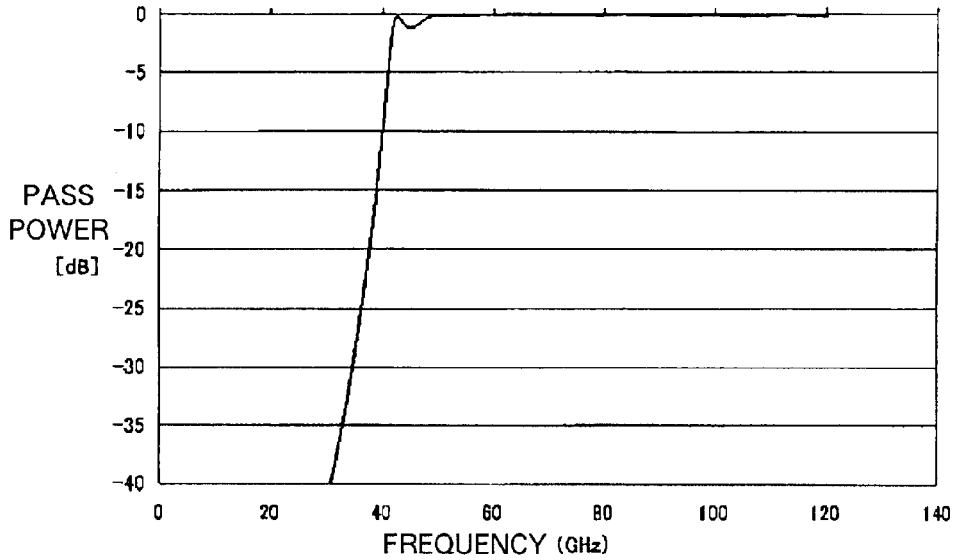
FIG. 4 is a graph showing a pass characteristic per line length 10 [mm] according to this embodiment.
Figure 5:
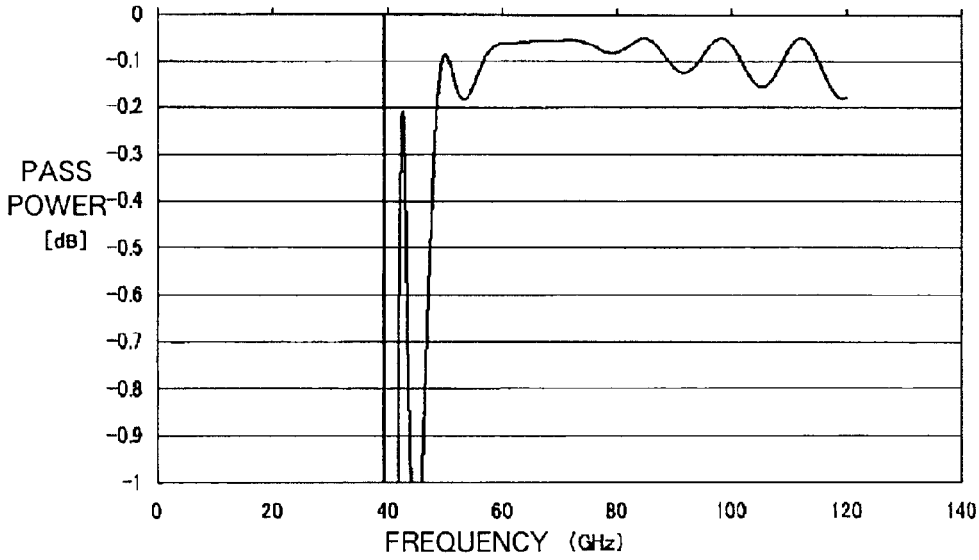
FIG. 5 is a graph showing a detailed pass characteristic per line length 10 [mm] according to this embodiment.
Figure 6:
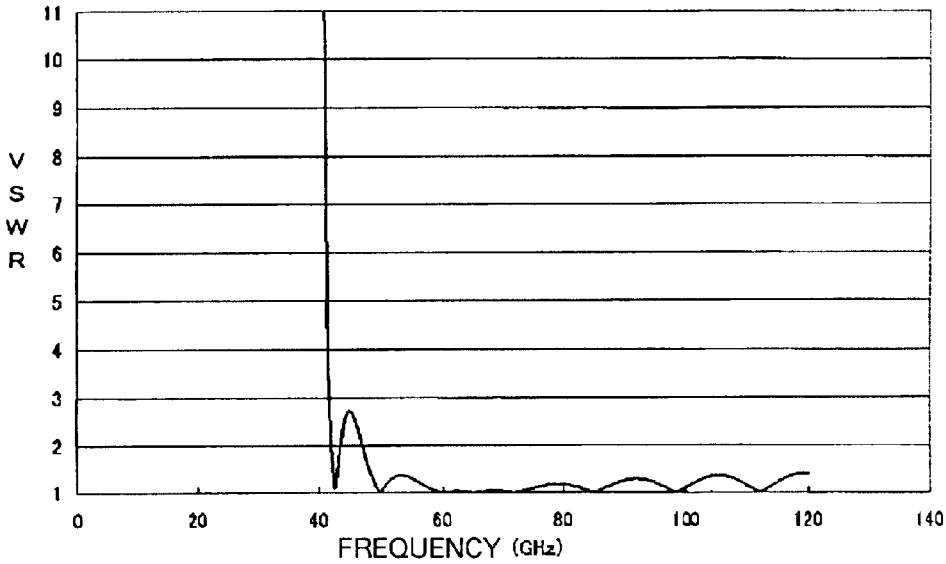
FIG. 6 is a graph showing a change in VSWR per frequency.
Figure 7:
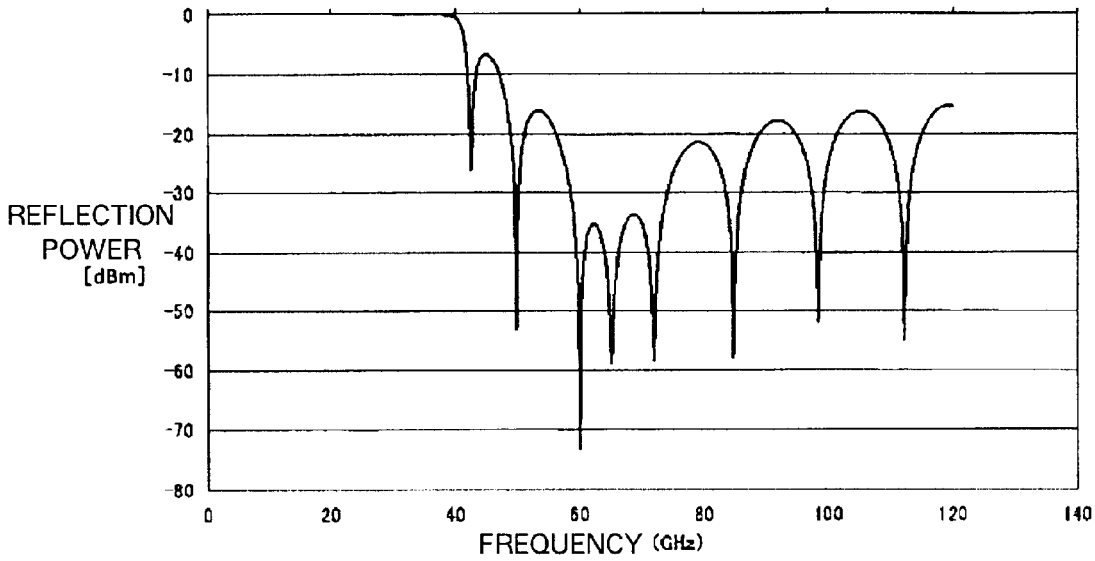
FIG. 7 is a graph showing a change in reflected power per frequency.

The pass loss per line length 10 [mm] in the tube axial direction when the inner diameter of the first circle 1*a* is 2.5 [mm], and the outer diameter of the second circle 1*b* is 1.8 [mm] under the condition where the frequency is 60 to 80 GHz is shown in the characteristic graphs of FIGS. 4 and 5. FIG. 5 shows a pass power (dB) per frequency, which is different only in the scale of the y-axis from FIG. 4. Also, the reflection characteristic is shown in FIGS. 6 and 7. FIG. 6 shows VSWR per frequency, and FIG. 7 shows the reflection power (dBm) per frequency.

Referring to FIGS. 4-7, the pass loss is about 0.6 [dB ]converting to 100 [mm ](0.06 [dB ]per 10 [mm ] ). The pass loss of the normal coaxial line is about 1 [dB ]per 100 [mm ], and therefore, it is found that the loss efficiency is significantly improved.

The d/D is set to about 0.7, and the transmission characteristic impedance is set to 50 [Ω].

Modified Example

The electromagnetic wave transmission medium according to this embodiment can be configured with any structure other than the structure described above. FIGS. 8A to 8E are cross-sectional views showing modified examples thereof, and the outer sheath 20 is omitted for convenience.

Figure 8:
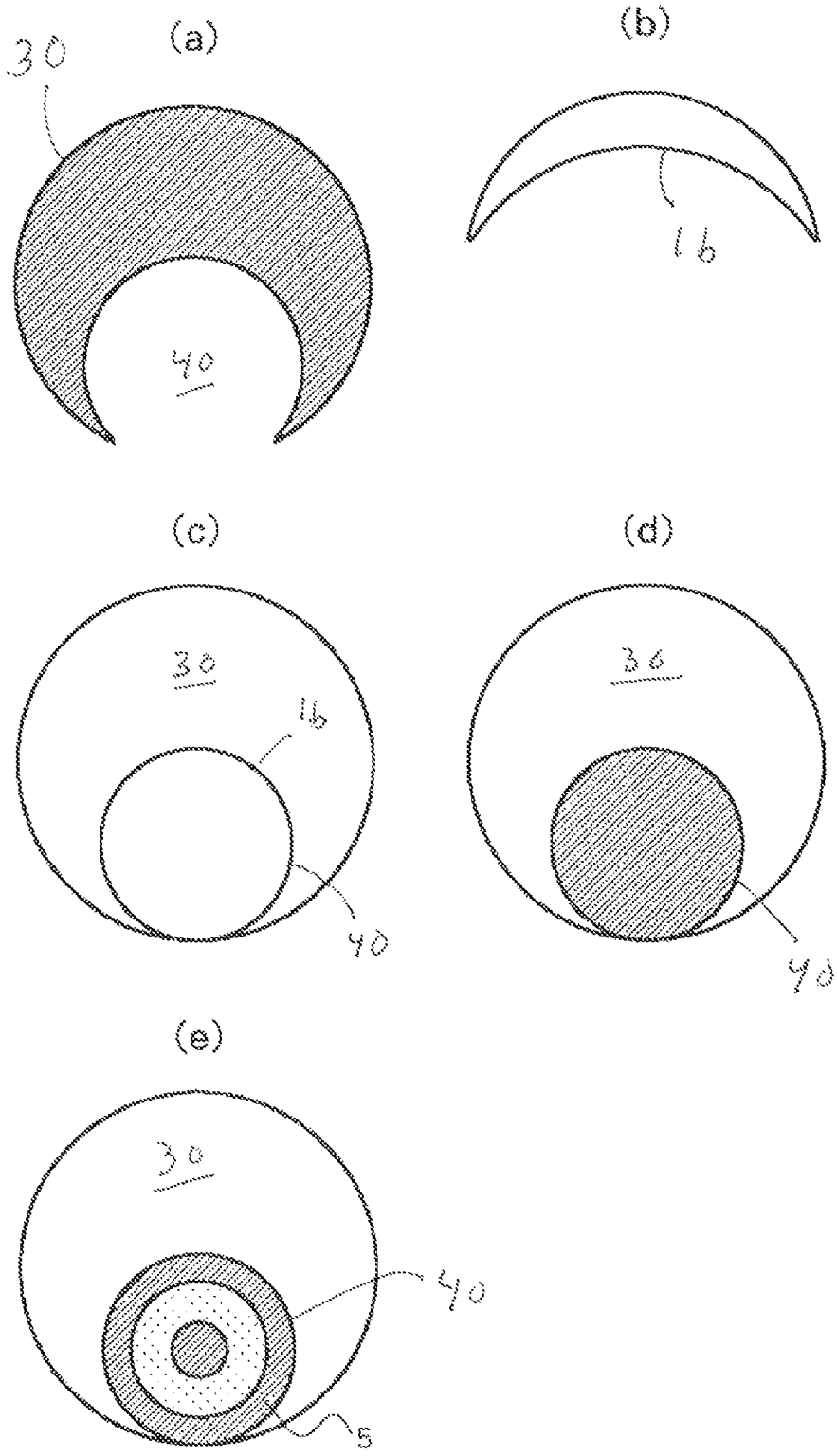
FIGS. 8A to 8E are diagrams showing modified examples, respectively.

FIG. 8A shows a structure in which a dielectric material is installed in the transmission space 30, and the depression space 40 is a free space. FIG. 8B shows a structure in which the arc angles of the second circle 1*b* are 90 degrees (180 degrees in total) to the right and left from the symmetric axis, respectively. FIG. 8C shows a structure in which the transmission space 30 is a free space, and the ridge formed by the second circle is hollow, and the arc angle of the second circle 1*b* is 360 degrees in total. FIG. 8D shows a structure in which a dielectric material is installed in the depression space 40 in the structure of FIG. 8C. FIG. 8E shows a structure in which a conductor line 5 coated with an insulator is arranged in the ridge 40 in the structure of FIG. 8C. In the structure of FIG. 8E, the transmission of the high frequency signal in the transmission space 30 and the transmission of a DC signal and a control signal through a conductor line 5 can be realized without using another line.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. An electromagnetic wave transmission medium, comprising:

a flexible circular cylindrical tube molded so that a cross-sectional shape of the flexible cylindrical tube in a direction orthogonal to a tube axis is uniform in a direction of the tube axis, the flexible cylindrical tube comprising an inner wall comprised of a conductive layer having a thickness equal to or greater than a skin depth; and a ridge having a structure to be fed with electricity, wherein a cross-sectional shape of the ridge is a solid circle shape, the ridge is oriented to a cylindrical axis and is symmetric with respect to a center, the solid circle shaped ridge is configured to minimize transmission degradation of the electromagnetic wave transmission medium while the electromagnetic wave transmission medium incurs a bend.

2. An electromagnetic wave transmission medium according to claim 1, wherein the cylindrical tube is obtained by disposing the conductive layer on a surface of a tube die made of a resin.

3. An electromagnetic wave transmission medium according to claim 1, wherein a transmission space is a closed surface shape in which an arc of a first circle forms the circular cylindrical tube, the arc of the first circle and an arc of a second circle having arc angles of 180 degrees or lower at regular intervals from a symmetric axis of the first circle are connected to each other, and the arc of the second circle forms the solid circle shaped ridge.

4. An electromagnetic wave transmission medium according to claim 3, further comprising another transmission medium disposed in a region surrounded by the arc of the second circle.

5. An electromagnetic wave transmission medium according to claim 3, wherein the transmission space has a size in which an electromagnetic wave introduced into the transmission space is cut off at a cutoff frequency fc (=1.84C/(ΠI√∈(D+d))), where C is a free space velocity of the electromagnetic wave, D is an inner diameter of the first circle, and d is an outer diameter of the second circle.

6. An electromagnetic wave transmission medium according to claim 5, wherein the transmission space is filled with a dielectric material.

7. An electromagnetic wave transmission medium according to claim 6, further comprising another transmission medium disposed in a region surrounded by the arc of the second circle.

8. An electromagnetic wave transmission medium according to claim 5, further comprising another transmission medium disposed in a region surrounded by the arc of the second circle.

9. An electromagnetic wave transmission medium according to claim 5, wherein the transmission space is a free space.

10. An electromagnetic wave transmission medium according to claim 9, further comprising another transmission medium disposed in a region surrounded by the arc of the second circle.

11. An electromagnetic wave transmission medium, comprising:

a flexible cylindrical tube molded so that a cross-sectional shape of the flexible cylindrical tube in a direction orthogonal to a tube axis is uniform in a direction of the tube axis, the flexible cylindrical tube comprising an inner wall comprised of a conductive layer having a thickness equal to or greater than a skin depth; and a ridge having a structure to be fed with electricity, wherein:

a cross-sectional shape of the ridge is a solid circle, a transmission space surrounding the ridge is a closed surface shape in which an arc of a first circle forms the circular cylindrical tube, the arc of the first circle and an arc of a second circle forms the circular cylindrical tube, having arc angles of 180 degrees or lower at regular intervals from a symmetric axis of the first circle are connected to each other, and the arc of the second circle forms the solid circle shaped ridge, and the ridge is oriented to a cylindrical axis and is symmetric with respect to a center.

12. An electromagnetic wave transmission medium according to claim 11, wherein the cylindrical tube is obtained by disposing the conductive layer on a surface of a tube die made of a resin.

13. An electromagnetic wave transmission medium according to claim 11, wherein the cross-sectional shape has a size in which an electromagnetic wave introduced into the transmission space is cut off at a cutoff frequency fc (=1.84C/(ΠI√∈(D+d))), where C is a free space velocity of the electromagnetic wave, D is an inner diameter of the first circle, and d is an outer diameter of the second circle.

14. An electromagnetic wave transmission medium according to claim 13, wherein the transmission space is a free space.

15. An electromagnetic wave transmission medium according to claim 14, further comprising another transmission medium disposed in a region surrounded by the arc of the second circle.

16. An electromagnetic wave transmission medium according to claim 13, wherein the transmission space is filled with a dielectric material.

17. An electromagnetic wave transmission medium according to claim 16, further comprising another transmission medium disposed in a region surrounded by the arc of the second circle.

18. An electromagnetic wave transmission medium according to claim 13, further comprising another transmission medium disposed in a region surrounded by the arc of the second circle.

19. An electromagnetic wave transmission medium according to claim 11, further comprising another transmission medium disposed in a region surrounded by the arc of the second circle.

20. An electromagnetic wave transmission medium, comprising:

a flexible cylindrical tube molded so that a cross-sectional shape of the flexible cylindrical tube in a direction orthogonal to a tube axis is uniform in a direction of the tube axis, the flexible cylindrical tube comprising an inner wall comprised of a conductive layer having a thickness equal to or greater than a skin depth; and a ridge having a structure to be fed with electricity, wherein:

a cross-sectional shape of the ridge is a solid circle, a transmission space surrounding the ridge is a closed surface shape in which an arc of a first circle forms the circular cylindrical tube, the arc of the first circle and an arc of a second circle forms the circular cylindrical tube, having arc angles of 180 degrees or lower at regular intervals from a symmetric axis of the first circle are connected to each other, and the arc of the second circle forms the solid circle shaped ridge, the transmission space has a size in which an electromagnetic wave introduced into the transmission space is cut off at a cutoff frequency fc (=1.84C/(Π√∈(D+d))), where C is a free space velocity of the electromagnetic wave, D is an inner diameter of the first circle, and d is an outer diameter of the second circle, and the ridge is oriented to a cylindrical axis and is symmetric with respect to a center.

* * * * *